US005893235A

United States Patent [19]

Almond

[11] Patent Number: 5,893,235

[45] Date of Patent: Apr. 13, 1999

[54] REMOVABLE SECURITY APPARATUS FOR BUILDING OPENINGS

[76] Inventor: Gary L. Almond, 3404 Osborne Blvd., Racine, Wis. 53405

[ * ] Notice: This patent is subject to a terminal disclaimer.

[21] Appl. No.: 08/874,193

[22] Filed: May 27, 1997

Related U.S. Application Data

[63] Continuation-in-part of application No. 08/611,598, Mar. 8, 1996, Pat. No. 5,740,628.

[51] Int. Cl.[6] ..... E05B 65/04

[52] U.S. Cl. ..... 49/61; 49/57; 49/63; 49/141; 49/506; 182/93; 182/94

[58] Field of Search ..... 49/61, 62, 63, 49/67, 68, 70, 50, 57, 141, 506; 182/48, 49, 93, 94

[56] References Cited

U.S. PATENT DOCUMENTS

| | | |
|---|---|---|
| 999,682 | 8/1911 | Suits . |
| 1,105,791 | 8/1914 | Irving . |
| 1,507,478 | 9/1924 | Gray . |
| 1,657,908 | 1/1928 | Wulftange . |
| 1,730,151 | 10/1929 | Kemp . |
| 2,722,722 | 11/1955 | Mussman . |
| 3,763,615 | 10/1973 | Yamazaki . |
| 3,871,151 | 3/1975 | Der Estephanian . |
| 4,038,800 | 8/1977 | Daley, Jr. . |
| 4,162,590 | 7/1979 | Earley . |
| 4,416,084 | 11/1983 | Zen . |
| 4,445,589 | 5/1984 | Longenecker . |
| 4,495,728 | 1/1985 | Lynn . |
| 4,593,492 | 6/1986 | Lumenello . |
| 4,653,226 | 3/1987 | Woodrow . |
| 4,881,354 | 11/1989 | Pitt . |
| 4,897,961 | 2/1990 | Shone . |
| 5,269,096 | 12/1993 | Hade . |
| 5,339,567 | 8/1994 | Pierpont et al. . |
| 5,392,570 | 2/1995 | Cowan . |

*Primary Examiner*—Jerry Redman
*Attorney, Agent, or Firm*—Jansson, Shupe, Bridge & Munger, Ltd.

[57] ABSTRACT

A removable security bar apparatus for preventing ingress to a building opening such as a window or door. The apparatus includes a grille and moveable latch remote from the opening. The apparatus may be quickly removed from the opening and used as a ladder to exit the building through the opening in the event of an emergency.

13 Claims, 7 Drawing Sheets

REMOVABLE SECURITY APPARATUS FOR BUILDING OPENINGS

RELATED APPLICATION

This application is a continuation-in-part of U.S. patent application Ser. No. 08/611,598 filed Mar. 8 1996, now U.S. Pat. No. 5,740,628.

FIELD OF THE INVENTION

This invention is related generally to moveable and removable closures and, more particularly, to protective grilles for securing building openings.

BACKGROUND OF THE INVENTION

Crime is fast becoming a major concern to families, businesses and organizations. Hardly a day passes without some news story relating to a burglary or forced entry into a home or business. Almost everyone knows someone who has had their home, business or organization burglarized resulting in theft, property damage, personal injury, or more serious harm.

Security doors and windows are a well known means of preventing criminals from entering a building through a building opening. Security doors and windows typically consist of heavy metal bars or grates that are placed over a window or door opening to prevent criminals from entering the building. These security systems are typically secured to the building opening in a permanent manner (i.e., they are not removable). U.S. Pat. No. 4,162,590 (Earley), U.S. Pat. No. 3,871,151 (Der Estephanian) and U.S. Pat. No. 1,657,908 (Wulftange) are examples of permanently-mounted security bars or grates.

While permanently-mounted security bars may prevent criminals from breaking into a building they also present serious safety concerns for people in the building. For example, security bars may prevent egress in the event of an emergency such as a fire. A person inside the structure who would normally escape the fire by exiting through a basement or ground floor window could find his or her means of egress blocked.

In response to this serious safety problem, others have sought to develop security bars which can be removed in the event of an emergency. U.S. Pat. No. 5,339,567 (Pierpont), U.S. Pat. No. 5,269,096 (Hade), U.S. Pat. No. 4,653,226 (Woodrow), U.S. Pat. No. 1,507,478 (Gray) and U.S. Pat. No. 999,682 (Suits) are all examples of removable security devices.

However, these removable security bar devices all have certain disadvantages. For example, Pierpont, Hade, Gray and Suits each secure their bars with a key-actuated lock located near the window opening. Operation of a lock would be impossible if the key were lost or misplaced. In addition, operation of a lock may be beyond the ability of a person who is panicking in an emergency situation such as a fire or criminal home invasion. Minimally, a person in a state of panic would require excessive time to actuate the lock; such time may not be available in an emergency. The close proximity of these locks to the window openings may also make these inventions vulnerable to a burglar skilled in dismantling locks.

Even if the security bar of these devices were removable, the location of the window could cause serious problems for a person seeking to exit the building in an emergency. For example, basement and ground floor windows (such as casement windows) are often secured by window bars because they are located near ground level and are potential entry points for burglars. However, these types of windows may be located five or six feet off the floor making it impossible for a person inside the building to climb up to the window in order to exit the building. A ladder would be required to gain access to such a window and a ladder is not typically available—particularly in an emergency situation.

A security system which would prevent ingress through a building window or other opening yet also serve as a ladder-like support to facilitate immediate exit from the building opening by a person inside the building would represent an important advance in the art.

OBJECTS OF THE INVENTION

It is an object of this invention to provide an improved security apparatus overcoming some of the problems and shortcomings of devices of the prior art.

Another object of this invention is to provide an improved security apparatus which securely covers a window or other building opening thereby preventing ingress to the building.

Yet another object of this invention is to provide an improved security apparatus which remains securely in place without the need for a key-actuated lock.

A further object of this invention is to provide an improved security bar apparatus which may be rapidly and easily removed from a window or other building opening facilitating egress from the building.

It is also an object of this invention to provide an improved security bar apparatus which can serve as a support to gain access to a building opening located above the floor of a room thereby facilitating egress from the building.

These and other important objects will be apparent from the following descriptions and from the drawings.

SUMMARY OF THE INVENTION

Briefly described, the invention includes an apparatus and method for preventing ingress through a building opening and for facilitating egress through such opening in an event such as a fire or other emergency. The improved apparatus includes a frame secured to an inside wall of the building and near the building opening to be secured. The frame includes two frame members extending along respective spaced axes.

The device further includes a grille structure which prevents ingress through the building opening and can also serve as a ladder-like support for exiting the building through the opening. The grille structure includes a pair of spaced grille supports each mounted for movement with respect to a respective one of the frame members.

The grille supports may be mounted on their respective frame members in any way which facilitates the desired movement of the grille supports with respect to the frame. For example, in certain embodiments each grille support may be in a telescoping relationship with a respective one of the said two frame members. In other embodiments, each grille support may simply be in a sliding relationship with a respective one of the said two frame members. Each grille support has a first end which will be described more fully below.

The grille structure further includes a pair of laterally-disposed structure members and upper and lower horizontal bar members extending between the structure members. These components form a grille capable of preventing ingress through the opening. The laterally-disposed structure members are pivotally coupled to a respective grille support first end.

It is preferred that a latch mechanism be provided and that the latch mechanism is mounted for movement between a first position limiting movement of the grille structure away from the opening and a second position permitting movement of the grille structure away from the opening.

The apparatus can be oriented in a "security position" and preferably in a "support position" as well. In the security position, the grille structure is extended over the building opening so as to obstruct the opening from entry. In this position, the grille structure is spaced from the floor.

In the support position, the grille structure is moved away from the opening and an end of the grille structure rests of a support surface, such as the building floor. The grille support is held in place by the frame and the support surface thereby serving as a ladder-like device for exiting the building opening.

It is highly preferred that the latch mechanism is positioned remote from the opening and is accessible only from inside the building. Preferably, the latch mechanism is pivotally mounted on a surface remote from the opening, such as the frame or the interior wall. Preferably, the latch mechanism may be quickly moved to a position which does not interfere with movement of the grille structure. In highly preferred embodiments the latch mechanism includes an arm having an opening for attaching the latch to a surface remote from the opening and a latch stop member attached to the arm for engaging one of the horizontal bar members. The inventive latch secures the grille without requiring a lock or other fastener thereby facilitating removal of the grille in the event of emergency.

Preferred embodiments include at least one support device for holding the grille structure in a position substantially obstructing the opening. An upwardly-opening hook is a preferred structure for use as the support device.

The inventive method for preventing ingress through a building opening and for aiding in rapid egress through the opening comprises the steps of: (a) securing a frame with respect to a building opening; and (b) movably securing a grille structure to the frame, the frame and grille structure cooperating so that the grille structure has a first position obstructing the opening and a second position in which the grille structure acts as a ladder-like device for exiting the building through the opening. Pursuant to the method, entry through the opening is denied to intruders yet egress from the building through the opening is facilitated in the event of emergency or the like.

In certain preferred forms of the method, the frame and grille structure are in telescoping relationship while in other forms of the inventive method the frame and grille structure are in sliding relationship.

Preferred forms of the method include the additional step of securing a moveable latch inside the building and with respect to the grille structure so that the grille structure may not be removed from the opening. The method may also include the step of releasing the moveable latch from inside the building so that the grille structure may be moved away from the opening and placed into position as a ladder-like device to facilitate egress from the building.

DETAILED DESCRIPTIONS OF THE PREFERRED EMBODIMENTS

Figure 2:
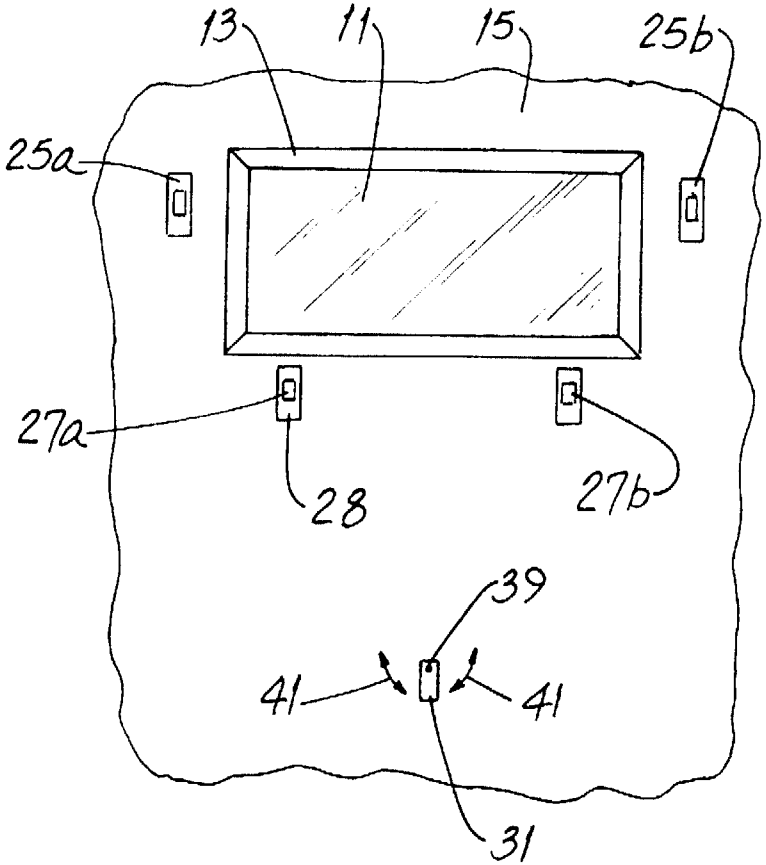
FIG. 2 is another embodiment of a removable security apparatus for securing a building opening.
Figure 1:
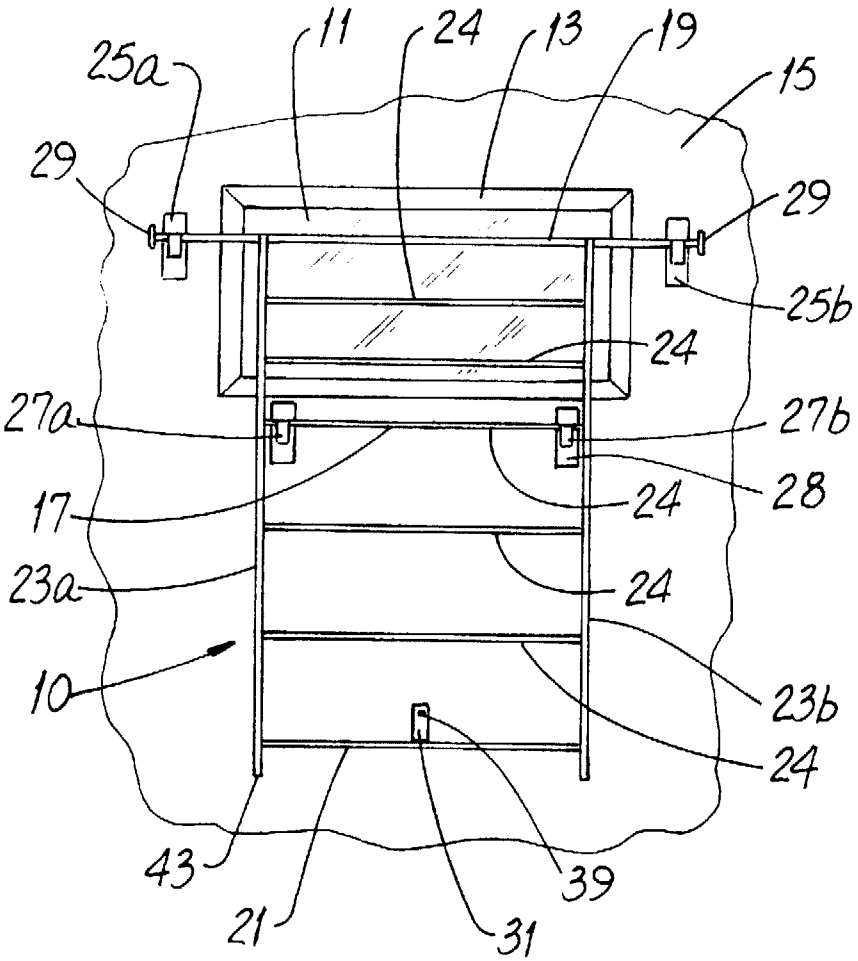
FIG. 1 is a front elevation of an embodiment of a removable security apparatus for securing a building opening.
Figure 8:
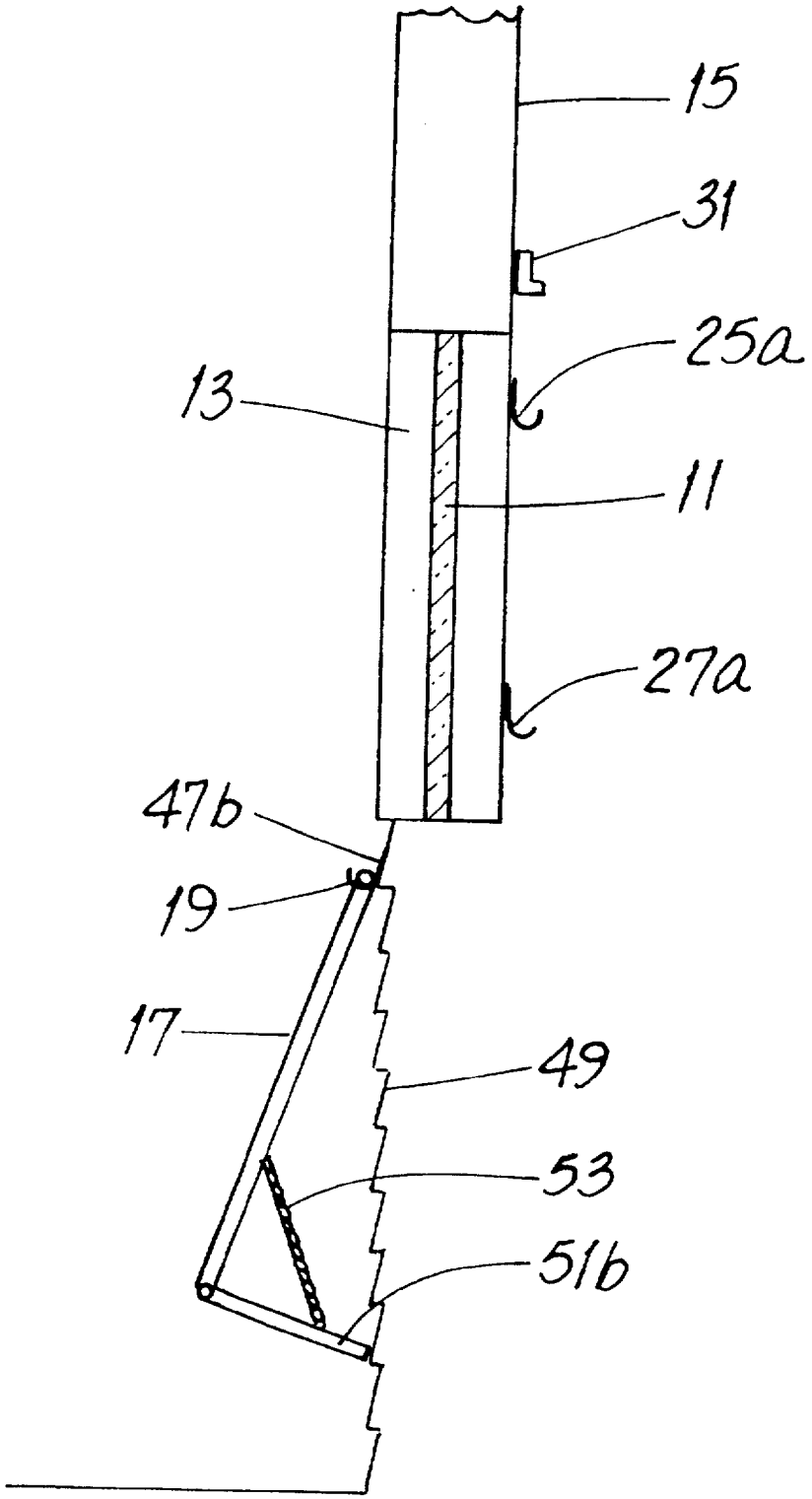
FIG. 8 is a side elevation of another removable security apparatus showing the grille positioned outside a building in a further "support position" to facilitate egress through the building opening.
Figure 9:
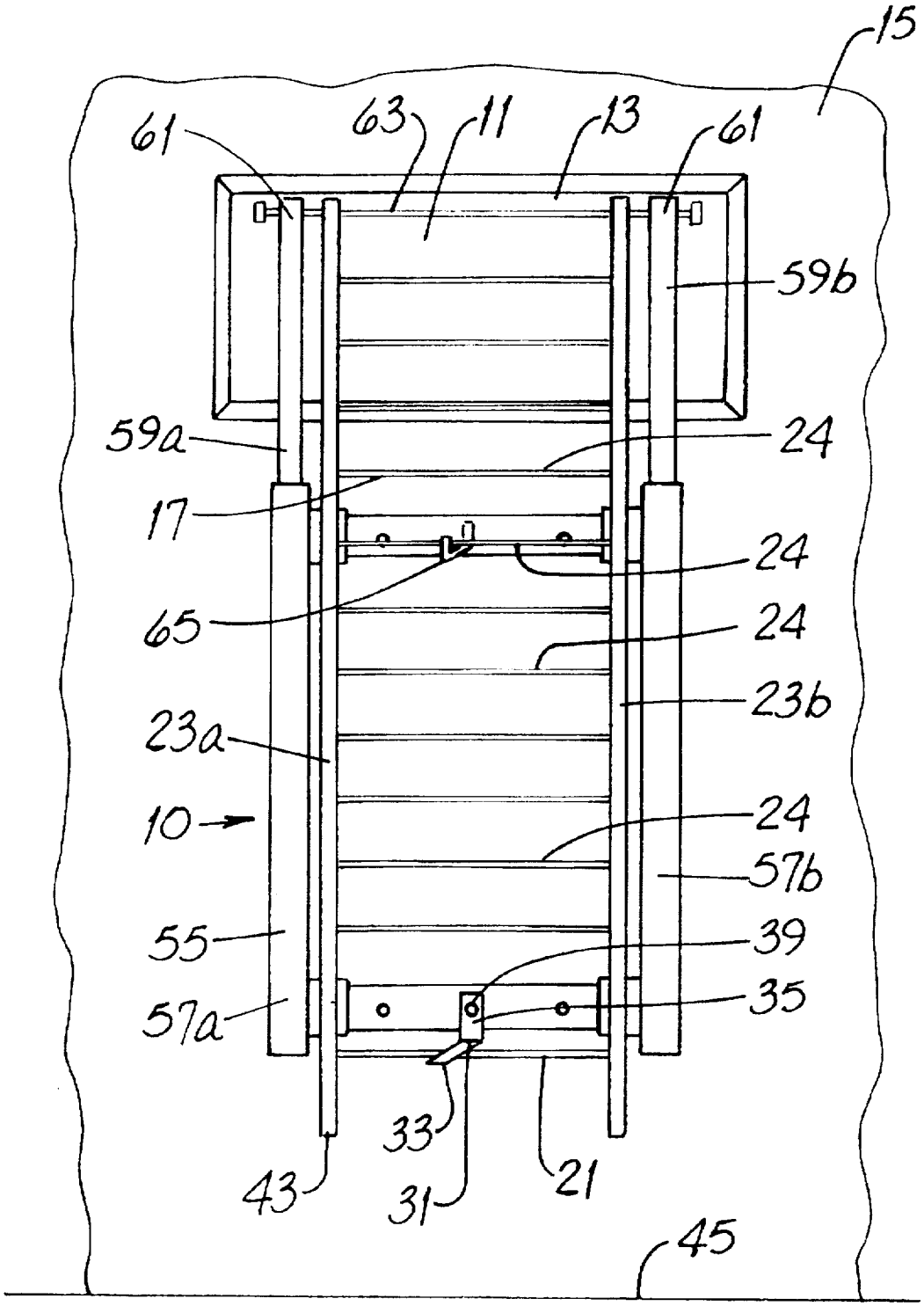
FIG. 9 is a front elevation of an embodiment of the invention showing a removable security apparatus for securing a building opening.
Figure 10:
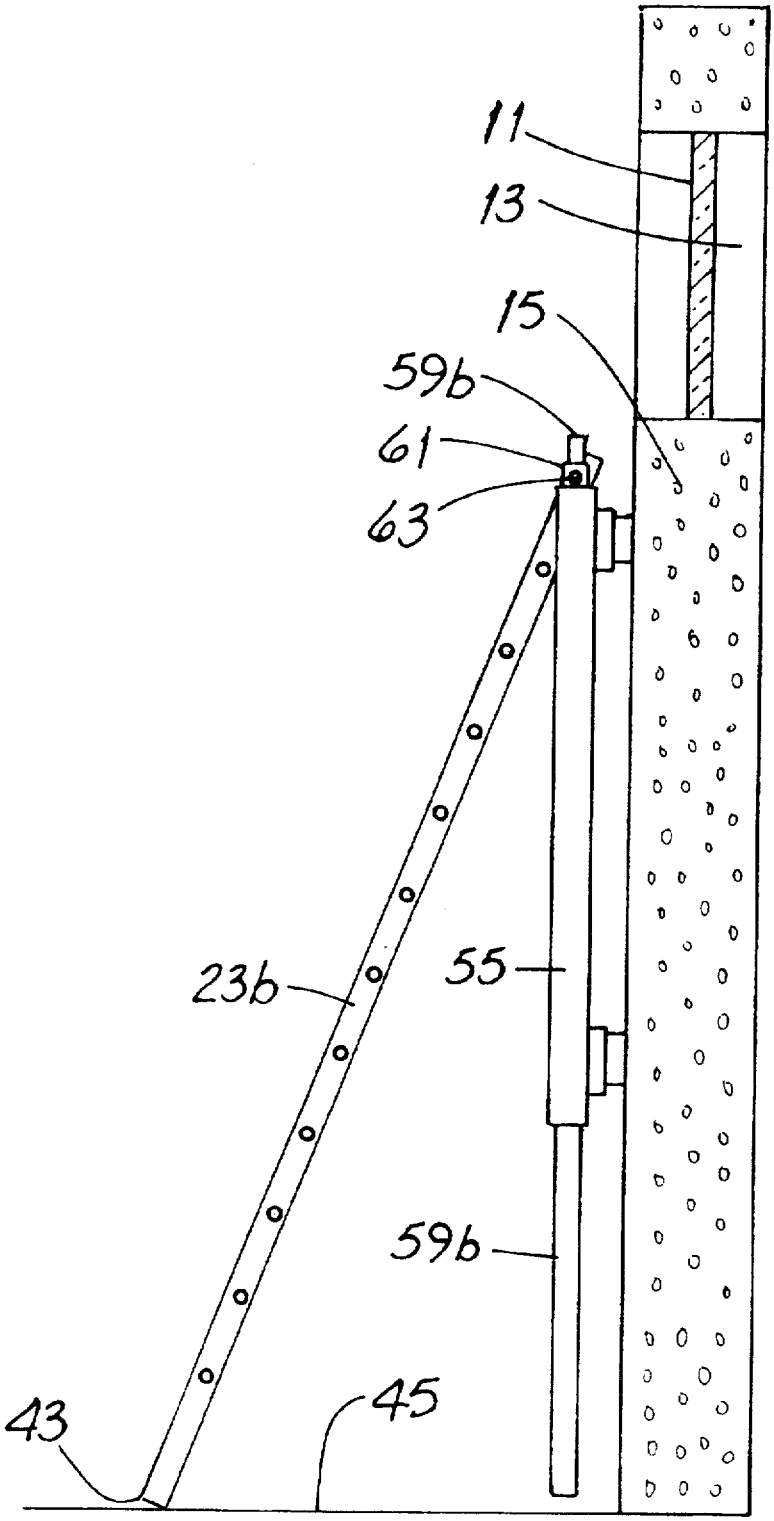
FIG. 10 is a side elevation of a removable security apparatus of the invention showing the grille in a "support position" to facilitate egress through the building opening.

FIGS. 1 and 2 show one embodiment of a security apparatus 10 positioned inside a building such as a home or business and FIGS. 9 and 10 show a further embodiment such as specifically claimed in this application. Apparatus 10 is intended to prevent burglars and the like from gaining unauthorized entry to a building through window 11 secured in window opening 13. In FIGS. 9 and 10, opening 13 is positioned in wall surface 15 and above a floor surface 14. Such an exemplary opening 13 is typically found in a garden level apartment or in a below-grade basement. However, such an opening 13 could also be commonly found at an above-ground-level location such as shown in FIG. 8.

The invention includes a grille structure 17 removably secured with respect to opening 13. Grille 17 is positioned inside the building. Grille 17 has an upper horizontal bar member 19 at least one lower horizontal bar member 21 and a pair of laterally-disposed structure members **23*a* and 23*b* coupled to the horizontal members 19 and 21. Preferably, a plurality of horizontal members 24 are provided on grille 17. Grille 17** may be made of any suitable material although wrought iron is preferred because of its strength and ease of manufacture.

In certain embodiments of a security apparatus 10, grill 17 is removably supported with respect to opening 13 by a pair of upper grille supports **25*a* and 25*b* and a pair of lower grille supports 27*a* and 27*b* positioned inside the building on wall surface 15. FIG. 1 shows grille 17 positioned on supports 25*a*, 25*b* and 27*a*, 27*b*. FIG. 2 shows supports 25*a*, 27*b* and 27*a*, 27*b* with grille 17 removed. Upper grille supports 25*a*, 25*b* receive one horizontal bar member 19 and lower grille supports 27*a*, 27*b* receive another horizontal bar member such as bar member 24. Preferably in such embodiments, the supports are upwardly-opening hooks each mounted to a plate 28 although any comparable support will suffice. Again, wrought iron is a preferred material for the supports 25***a*, 25*b* and 27*a*, 27*b*.

In the embodiments shown, upper grille supports 25*a*, 25*b* and lower grille supports 27*a*, 27*b* are attached to wall surface 15 by means of any suitable fastener (not shown). Upper 25*a*, 25*b* and lower 27*a*, 27*b* grille supports are positioned on wall surface 15 adjacent to lateral members 23*a*, 23*b* so as to interfere with lateral movement of the grille 17. In the embodiments shown in FIGS. 1–2 and 6–8, each upper grille support 25*a*, 25*b* is positioned between a lateral member 23*a*, 23*b*, respectively, and a bar stop member 29 and each lower grille support 25*a*, 25*b* is positioned abutting a lateral member 25*a*, 25*b*, respectively, thereby preventing lateral movement of grille 17 when positioned on supports 23*a*, 23*b* and 27*a*, 27*b*.

In each embodiment, vertical movement of grille 17 is restricted by latch mechanism 31 which is positioned remote from opening 13. By remote, Applicant means that the latch 31 is located at a position far enough from opening 13 that someone outside the building could not reach in the opening 13 and operate latch 31. Thus, latch 31 could be mounted above (FIG. 8), below (FIGS. 1,2,6–7, 9–12) or to the side (not shown) of opening 13. This advantageous arrangement avoids the need for any key-operated locking mechanism which is a necessity for latches which are positioned along the opening 13.

Figure 3:
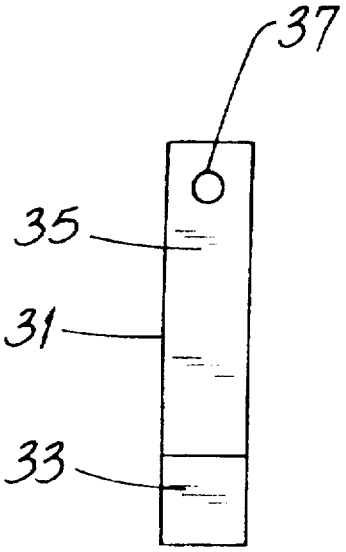
FIG. 3 is a front elevation of an embodiment of a removable security apparatus for securing a building opening.
Figure 4:
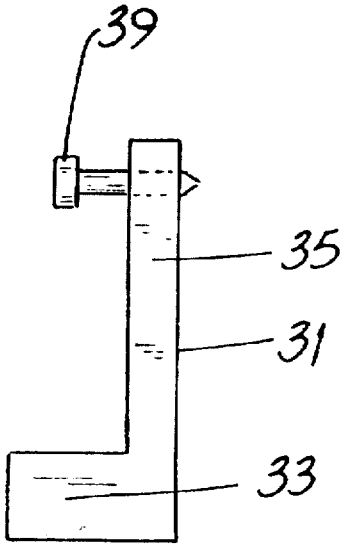
FIG. 4 is a side elevation view of one embodiment of remote latching mechanism.
Figure 5:
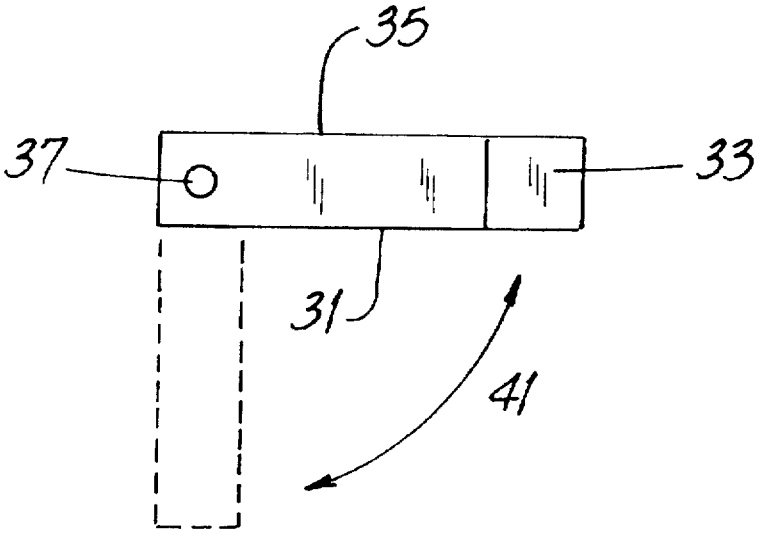
FIG. 5 shows one embodiment of the remote latching mechanism and represents the pivotal movement of such latch.

FIGS. 3–5 show one embodiment of a preferred latch 31. Latch 31 may include a latch stop member 33 and an arm 35. Latch opening 37 is positioned in arm 35 for securing latch 31 to a surface such as wall 15. Any suitable fastener (such as lag screw 39) may be used to secure latch 31 to surface 15. As shown in FIGS. 2 and 5 latch 31 is preferably pivotally mounted to wall surface 15 as represented by number 41.

Figure 6:
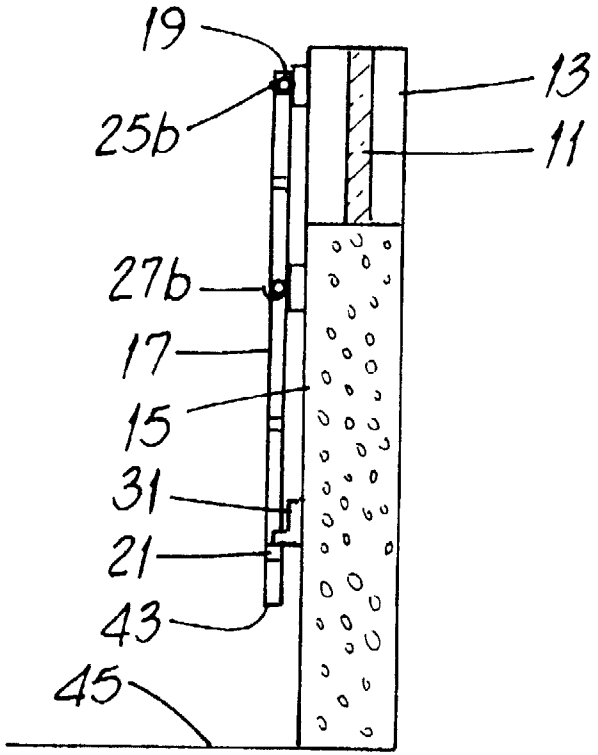
FIG. 6 is a side elevation of a removable security apparatus for securing a building opening showing the grille in a "security position" mounted over a building opening.

As shown in FIGS. 1, 6, and 9 stop member 33 is positioned below latch opening 37 to be in engagement with horizontal member 21. Latch 31 could be in contact with other horizontal members 24 provided such members are remote from the opening 13. As shown in FIG. 8, the latch 31 may also be positioned above grille 17 and in engagement with upper horizontal bar member 19. Preferably, stop member 33 may be weighted such that gravity maintains stop member 33 in engagement with its corresponding horizontal member.

In either arrangement, for the embodiments shown in FIGS. 1–8, latch 31 and supports 25*a*, 25*b* and 27*a*, 27*b* prevent grille 17 from being moved upwardly, off supports 25*a*, 25*b* and 27*a*, 27*b* and away from opening 13. However, grille 17 may be easily and rapidly removed from supports 25*a*, 25*b* and 27*a*, 25*b* simply by pivoting latch 31 away from horizontal member 21 and lifting grille 17 off of supports 25*a*, 25*b* and 27*a*, 27*b*.

FIGS. 1, 6 and 9 and FIGS. 7 and 10 show the device in its "support" and "security" positions respectively. In the security position shown in FIGS. 1 and 6, horizontal members 19 and 24 are received in grille upper 25*a*, 25*b* and lower 27*a*, 27*b* supports, respectively. At least one horizontal member such as 19 or 24 is positioned to obstruct opening 13.

Figure 7:
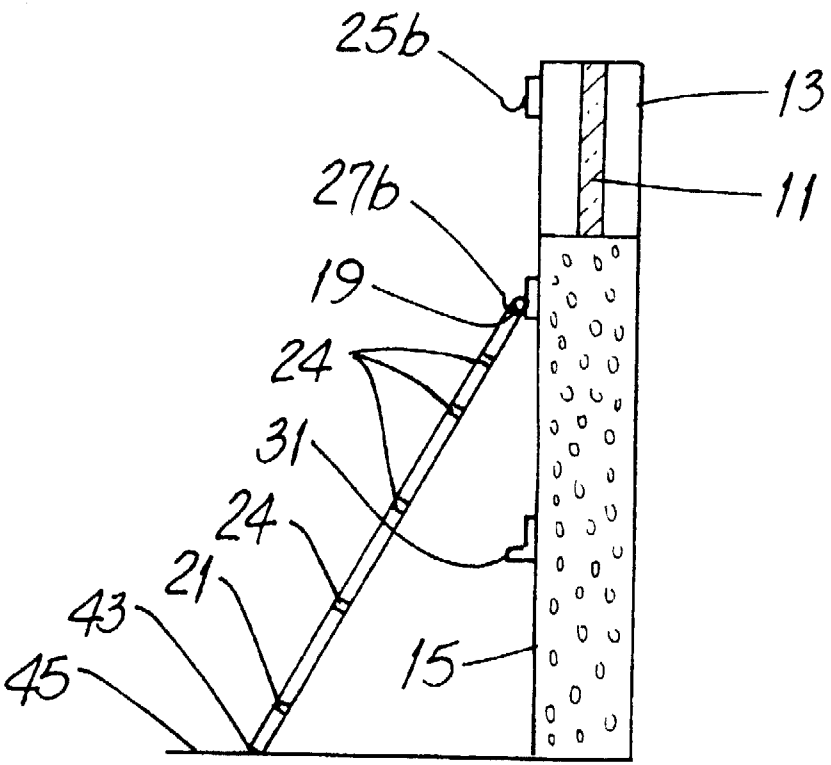
FIG. 7 is a side elevation of a removable security apparatus showing the grille in a "support position" to facilitate egress through the building opening.

In the support position shown in FIGS. 7 and 10, grille 17 is positioned to act as a ladder-like support to assist a person inside the building in exiting through opening 13. In FIG. 7, lower grille supports 27*a*, 27*b* receive upper horizontal bar member 19 and the bearing end 43 of grille 17 is positioned against bearing surface 45. The grille 17 is, therefore, preferably at an angle relative to surface 15 to further facilitate egress through opening 13.

FIG. 8 shows yet another embodiment of Applicant's invention used to assist in exiting from the opening 13 to the ground outside the building. In this embodiment, a pair of grille supports 47*a* (not shown) and 47*b* are positioned on the building exterior surface 49. Paired grille supports 47*a*, 47*b* are positioned to receive upper horizontal bar member 19 of grille 17. Grille 17 may further include a pair of extenders 51*a* (not shown) and 51*b* each pivotally mounted to a lateral member 23*a* or 23*b* and extensible toward the building exterior 49 for supporting grille 17 along the building. Preferably, a stop, such as a chain 53, limits movement of each extender 51*a*, 51*b* so that each extender 51*a* or 51*b* supports grille 17 with respect to exterior surface 49. In this embodiment, grille structure 17 may be removed from opening 13 and positioned outside the building to facilitate egress through opening 13.

FIGS. 9–12 exemplify a preferred embodiment specifically representing the present invention. This embodiment is not intended to be limiting as there are other potential ways to exemplify the invention.

Figure 11:
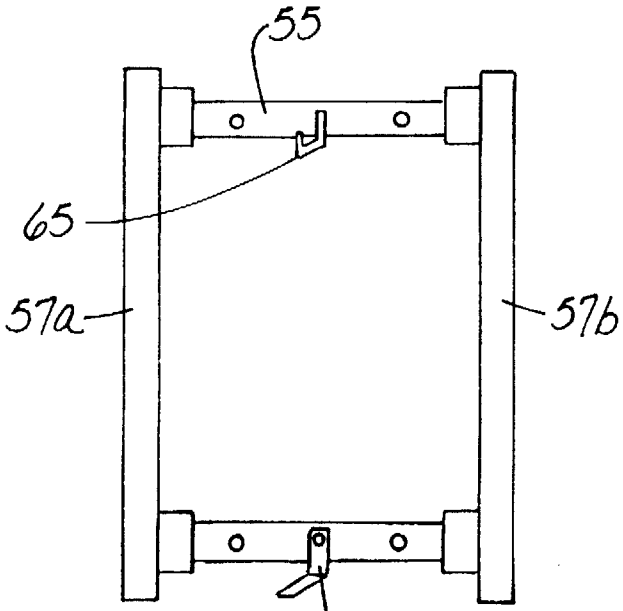
FIG. 11 is a front elevation of the frame of one embodiment of Applicant's removable building security apparatus.

As shown in FIGS. 9–11, the invention includes a frame 55 secured to wall surface 15 and with respect to opening 13. Frame 55 is preferably made of wrought iron and is mounted to wall 15 by suitable fasteners such as lag screws. Frame 55 includes frame members 57*a* and 57*b*. In the embodiment show in FIGS. 9–11, the frame members 57*a* and 57*b* are made of tubular metal for receiving grille supports 59*a* and 59*b* in a telescoping relationship.

Figure 13:
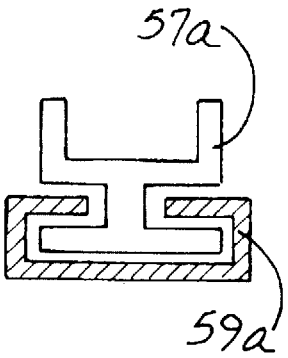
FIG. 13 is a cross-sectional view of an alterative embodiment of the frame and grille supports.
Figure 12:
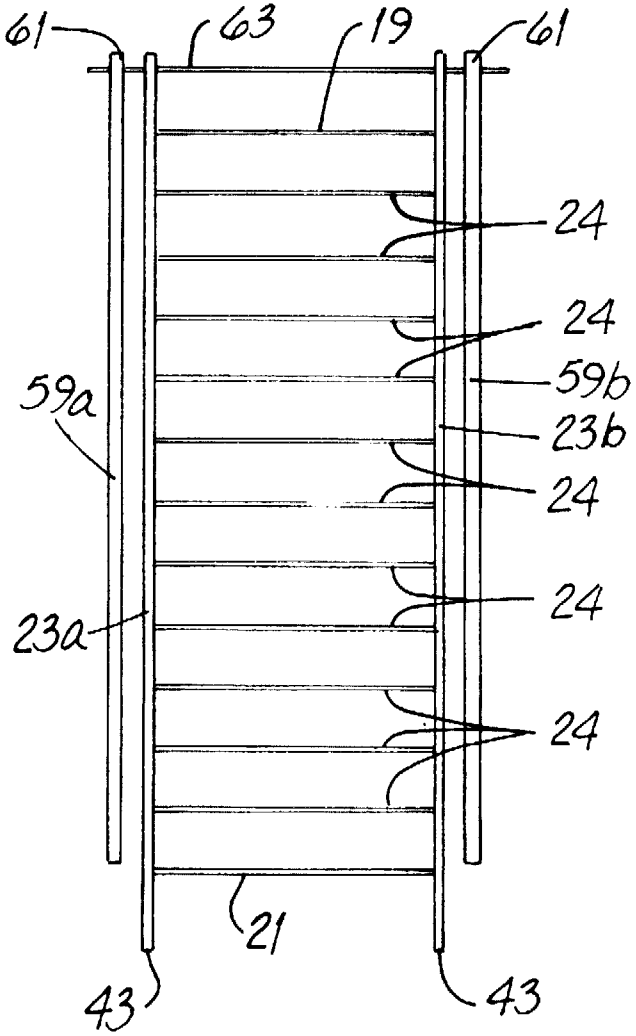
FIG. 12 is a front elevation of the grille structure of one embodiment of Applicant's removable building security apparatus.

Grille structure 17 is shown in FIGS. 9–10 and 12. Grille structure 17 includes a pair of spaced grille supports 59*a* and 59*b* each mounted for sliding movement (telescoping movement in the case of FIGS. 9–10 and 12) with respect to a respective frame member 57*a* or 57*b*. Other configurations of the supports 59*a* and 59*b* and frame members 57*a* and 57*b* are within the scope of the invention. One such alternative configuration is shown in FIG. 13 which shows a cross-sectional view of frame member 57*a* and grille support 59*a* in which the frame member 57*a* and support 59*a* are in sliding relationship. In this embodiment, grille support 59*a* has a "C" shaped cross section which cooperates with frame member 57*a* to provide the sliding relationship between the parts 57*a* and 59*a*.

Each grille support 59*a* and 59*b* has a first end 61 and bearing end 43.

Grille structure 17 further includes a pair of laterally-disposed structure members 23*a* and 23*b*. Each member 23*a* and 23*b* is movably coupled to a respective grille support (59*a* or 59*b*) first end 61. The form of the coupling is not particularly restricted. For example, members 23*a* and 23*b* may each be attached by separate fasteners to the respective support 59*a* or 59*b* (not shown) or as shown in FIG. 9, grille structure 17 may be movably attached to supports 59*a* and 59*b* by rod 63 positioned through first ends 61 and supports 59*a* and 59*b*. As shown in FIG. 9, stop members 29 may be provided to maintain the position of rod 63 with respect to supports 59*a* and 59*b* and laterally-disposed structure members 23*a* and 23*b*. Stop members 29 may, for example, consist of nuts positioned on threads at each end of rod 63.

Grille 17 further includes upper 19 and lower 21 horizontal bar members extending between structure members 23*a* and 23*b*. Additional horizontal bar members 24 are shown.

The latch mechanism shown in FIGS. 9–11 is similar to the latch described with respect to the embodiment shown in FIGS. 3–5. The latch 31 is mounted for rapid movement between a first position limiting movement of the grille structure away from opening 13 and a second position permitting movement of the grille structure 17 away from opening 13. The latch is not required to be in direct contact with the member any particular member 21 or 24 when grille structure 17 is in the first position. Moreover, latch 31 is not required to be weighted as shown in the preferred embodiments of FIGS. 3–5. For example, a standard piece of angle iron would be suitable for use as latch 31 provided that latch 31 interferes appropriately with movement of grille structure 17.

FIGS. 3–5 and 9–11 show latch 31 mounted for pivotal movement which is preferred. Other types of moveable mountings are acceptable. Latch 31 may be mounted on frame 17 as shown in FIG. 9 or may be attached to wall surface 15. In either case, latch 31 is remote from opening 13 thereby preventing an intruder from reaching through opening 13 to actuate the latching mechanism. While not preferred, a lock could be mounted with respect to latch 31 to prevent movement of latch 31.

As shown in FIGS. 9 and 11, a support 65 may be provided to hold the grille structure 17 in a position substantially obstructing building opening 13.

According to the method of this invention, grille 17 is positioned in the "security position" shown in FIG. 9 by securing frame 55 with respect to opening 13. Grille structure 17 is removably secured to frame 55. Grille structure 17 and frame 55 cooperate such that grille 17 has a first position (shown in FIG. 9) obstructing the opening 13 and a second position (shown in FIG. 10) in which the grille structure 17 acts as a ladder-like device for exiting the building through the opening 13.

In the embodiment shown in FIGS. 9 and 10, grille structure 17 is held in place over the opening 13 by support 65 and latch 31. Frame 55 engages grille supports 23*a* and 23*b* limiting lateral movement of grille structure 17 away from opening 13.

The embodiment shown in FIGS. 9–12 is rapidly placed into the support position by moving the latch 31 away from the member 21 and by lifting grille structure 17 up and off of support 65. Grille structure 17 is pivoted away from wall 15 and lowered until the first ends 61 contact the frame 17. In such position, and as shown in FIG. 10, the bearing end 43 of each grille structure 17 is in contact with surface 45 and grill structure 17 is positioned to be used as a support for exiting the building through opening 13.

While the principles of this invention have been described in connection with specific embodiments, it should be understood clearly that these descriptions are made only by way of example and are not intended to limit the scope of the invention.

What is claimed:

1. An apparatus for preventing ingress through a building opening, the apparatus comprising:

a frame configured to be secured to an inside wall of a building and with respect to the opening, the frame including two frame members extending along respective spaced axes;

a grille structure including (a) a pair of spaced grille supports mounted for movement with respect to a respective one of the frame members, each of the grille supports having a first end, (b) a pair of laterally-disposed structure members, each pivotally coupled to a respective grille support first end, and (c) upper and lower horizontal bar members extending between the structure members;

a latch mechanism mounted for movement between a first position limiting movement of the grille structure away from the opening and a second position permitting movement of the grille structure away from the opening, thereby configuring the grille structure to be mounted:

in a first position, whereby the grille structure is spaced from a building floor and obstructs the opening, and;

in a second position, whereby the grille structure contacts the floor and is positioned away from the opening.

2. The apparatus of claim 1 wherein each grille support is in a telescoping relationship with a respective one of the two frame members.

3. The apparatus of claim 1 wherein each grille support is in a sliding relationship with a respective one of the two frame members.

4. The apparatus of claim 1 wherein the latch mechanism is remote from the opening and accessible only from inside the building.

5. The apparatus of claim 4 wherein the latch mechanism is pivotally mounted to an interior wall surface region remote from the opening and the latch mechanism may be quickly moved to a position which does not interfere with movement of the grille structure.

6. The apparatus of claim 5 wherein the latch mechanism includes:

an arm having an opening for attaching the latch to a surface remote from the opening; and a latch stop member attached to the arm for engaging one of the horizontal bar members.

7. The apparatus of claim 1 further including at least one support device for holding the grille structure in a position substantially obstructing the opening.

8. The apparatus of claim 7 wherein each support device is an upwardly-opening hook.

9. A method for preventing ingress through a building opening and aiding in rapid egress through the opening comprising the steps of:

securing a frame with respect to the building opening;

movably securing a grille structure to the frame, the frame and grille structure cooperating so that the grille structure has a first position obstructing the opening and a second position in which the grille structure acts as a ladder for exiting the building through the opening;

whereby entry through the opening is denied to intruders yet egress from the building through the opening is facilitated in the event of emergency or need for rapid egress through the opening.

10. The method of claim 9 wherein the frame and grille structure are in telescoping relationship.

11. The method of claim 9 wherein the frame and grille structure are in sliding relationship.

12. The method of claim 9 further including the step of securing a moveable latch inside the building and with respect to the grille structure so that the grille structure may not be removed outwardly through the opening.

13. The method of claim 12 further including the step of releasing the moveable latch from inside the building so that the grille structure may be moved away from the opening and placed into position as a ladder to facilitate egress from the building.

* * * * *